US007089741B2

(12) United States Patent
Ikeda et al.

(10) Patent No.: US 7,089,741 B2
(45) Date of Patent: Aug. 15, 2006

(54) GAS TURBINE COMBUSTOR

(75) Inventors: Kazufumi Ikeda, Hyogo (JP); Tatsuo Ishiguro, Hyogo (JP); Katsunori Tanaka, Hyogo (JP); Satoshi Tanimura, Hyogo (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 10/927,529

(22) Filed: Aug. 27, 2004

(65) Prior Publication Data

US 2005/0097890 A1 May 12, 2005

(30) Foreign Application Priority Data

Aug. 29, 2003 (JP) ..... 2003-308062

(51) Int. Cl.
*F02C 7/24* (2006.01)

(52) U.S. Cl. ..... 60/725; 60/752

(58) Field of Classification Search ..... 60/725, 60/748, 752–760

See application file for complete search history.

(56) References Cited

U.S. PATENT DOCUMENTS 3,705,492 A * 12/1972 Vickers ..... 60/39.511
4,008,568 A * 2/1977 Spears et al. ..... 60/796
4,085,579 A * 4/1978 Holzapfel et al. ..... 60/774
4,112,676 A * 9/1978 DeCorso ..... 60/733
4,297,842 A * 11/1981 Gerhold et al. ..... 60/776
5,435,139 A * 7/1995 Pidcock et al. ..... 60/757
5,758,504 A * 6/1998 Abreu et al. ..... 60/754
5,802,841 A * 9/1998 Maeda ..... 60/784
6,098,397 A * 8/2000 Glezer et al. ..... 60/772
6,164,075 A * 12/2000 Igarashi et al. ..... 60/752
6,173,561 B1 * 1/2001 Sato et al. ..... 60/772
6,341,485 B1 * 1/2002 Liebe ..... 60/772
6,513,334 B1 * 2/2003 Varney ..... 60/776
6,530,221 B1 * 3/2003 Sattinger et al. ..... 60/725
6,826,913 B1 * 12/2004 Wright ..... 60/772
6,837,051 B1 * 1/2005 Mandai et al. ..... 60/725
6,860,098 B1 * 3/2005 Suenaga et al. ..... 60/39.23
2002/0066272 A1 * 6/2002 Suenaga et al. ..... 60/725
2003/0010014 A1 * 1/2003 Bland et al. ..... 60/39.37
2003/0233831 A1 * 12/2003 Suenaga et al. ..... 60/725
2005/0000226 A1 * 1/2005 McCaffrey et al. ..... 60/796

FOREIGN PATENT DOCUMENTS

JP 2002-174427 6/2002
JP 2003-214185 7/2003

* cited by examiner

*Primary Examiner*—William H. Rodriguez
(74) *Attorney, Agent, or Firm*—Kanesaka Berner & Partners, LLP

(57) ABSTRACT

A gas turbine combustor includes a combustion liner in which a combustion region is formed; and a housing provided for a wall of the combustion liner in a predetermined circumferential region of the combustion liner to form a resonance space between the combustion liner and the housing. The combustion region and the resonance space are connected by a plurality of combustion liner through-holes, and a circumferential length of the housing is longer than a diameter of the combustion liner.

29 Claims, 8 Drawing Sheets

GAS TURBINE COMBUSTOR

RELATED APPLICATIONS

The present application is based on, and claims priority from, Japanese Application Ser. No. 2003-308062, filed Aug. 29, 2003, the disclosure of which is hereby incorporated by reference herein in its entirety.

BACKGROUND OF THE INVENTION

1. Field of the Invention

The present invention relates to a gas turbine combustor, more particularly to a gas turbine combustor having a structure to reduce combustion vibration, and a gas turbine generation plant using the same.

2. Description of the Related Art

A gas turbine plant has a compressor, a combustor and a turbine. The compressor takes in air, compresses and discharges as high-pressure compressed air. The discharged compressed air is introduced to the combustor, and fuel is combusted by using the compressed air to produce hot combustion gas. The combustion gas is introduced to the turbine to drive the turbine.

When the fuel is combusted, the combustion vibration sometimes occurs in the combustor. In order to stably operate the gas turbine plant, it is necessary to effectively restrain the combustion vibration of the combustor.

A gas turbine is disclosed in Japanese Laid Open Patent Application (JP-P2002-174427A). In the gas turbine of this conventional example, a cylindrical body in which a combustion region is formed is provided and a resonator with a cavity is provided for the cylindrical body in the outer circumference. The resonator has sound absorption holes connected to the cavity.

Also, a resonator module to restrain combustion instability of a combustor in a gas turbine generation plant is disclosed in U.S. Pat. No. 6,530,221 B1. The resonator module of this conventional example is installed along a flow path of combustion gas downstream of the combustion zone of the combustor assembly, and contains a first member and a second member. The first member has a size smaller than the diameter of the flow path in a transition piece and has a plurality of openings connected to the flow path. The second member has substantially the same size as that of the first member. The second member is provided to cover the first member and a space is formed between the first and second members.

Also, a gas turbine combustor cooling structure is disclosed in Japanese Laid Open Patent Application (JP-P2003-214185A). In a gas turbine combustor with the gas turbine combustor cooling structure of this conventional example, a double wall section is provided to have an outer side wall and a combustion gas side wall, between which cooling air flows. A cover is provided for the outer side wall to form a cavity. Impingement cooling holes are formed in the cover and sound absorption holes are provided for the outer side wall and the combustion gas side wall. The cooling air passages are provided to avoid the sound absorption holes.

SUMMARY OF THE INVENTION

An object of the present invention is to provide a gas turbine combustor in which combustion vibration is restrained.

In an aspect of the present invention, a gas turbine combustor includes a combustion liner in which a combustion region is formed; and a housing provided for a wall of the combustion liner in a predetermined circumferential region of the combustion liner to form a resonance space between the combustion liner and the housing. The combustion region and the resonance space are connected by a plurality of combustion liner through-holes, and a circumferential length of the housing is longer than a diameter of the combustion liner.

Here, the distance between the wall of the combustion liner and the housing is desirably in a range of 10 mm to 30 mm, and the diameter of each of the plurality of combustion liner through-holes is desirably in a range of 1 mm to 5 mm. In addition, a percentage of a total of areas of the plurality of combustion liner through-holes to an area of the predetermined circumferential region is desirably in a range of 3 percent to 10 percent, and a thickness of the wall of the combustion liner is desirably in a range of 2 mm to 7 mm.

Also, the housing may include an upper section opposing to the wall of the combustion liner; and side sections extending from the upper section and connected with the wall of the combustion liner to form the resonance space. Holes are opened in at least one of the side sections. In this case, each of the side sections may include a flat plate section; and a curved section smoothly connecting the flat plate section and the upper section, such that an angle between the flat plate section and the upper section is obtuse.

Also, each of the side sections may be connected with the wall of the combustion liner such that an angle between the wall of the combustion liner and a surface of the side section opposite to the resonance space is obtuse. Also, a thickness of the housing is in a range of 1.6 mm to 5 mm, and a radius of curvature of the curved section is in a range of 5 mm to 20 mm.

Also, the resonance space may be single in an inside of the housing. Also, the housing may be single.

Also, the housing may be connected with an outer surface of the wall of the combustion liner, and an inner surface of the wall of the combustion liner corresponding to the housing may have a heat-resistant coating layer.

Also, the plurality of combustion liner through-holes may be uniformly distributed in the predetermined circumferential region. Or, the plurality of combustion liner through-holes may be ununiformly distributed in the predetermined circumferential region based on a temperature distribution in the combustion region.

The gas turbine combustor may further include a swirler assembly connected with the combustion liner; and a swirler assembly housing provided for a wall of the swirler assembly in a predetermined circumferential region of the swirler assembly to form a housing resonance space between the swirler assembly and the swirler assembly housing. The combustion region and the housing resonance space are connected by a plurality of swirler assembly through-holes, and a circumferential length of the swirler assembly housing is longer than a diameter of the swirler assembly.

In another aspect of the present invention, a gas turbine combustor includes a swirler assembly; a combustion liner connected with the swirler assembly, a combustion region being formed in the combustion liner; and a swirler assembly housing provided for a wall of the swirler assembly in a predetermined circumferential region of the swirler assembly to form a housing resonance space between the swirler assembly and the swirler assembly housing. A space in the swirler assembly and the housing resonance space are connected by a plurality of swirler assembly through-holes. A circumferential length of the swirler assembly housing is longer than a diameter of the swirler assembly.

Also, a distance between the wall of the swirler assembly and the swirler assembly housing is desirably in a range of 10 mm to 30 mm, and the diameter of each of the plurality of swirler assembly through-holes is desirably in a range of 1 mm to 5 mm. A percentage of a total of areas of the plurality of swirler assembly through-holes to an area of the predetermined circumferential region is desirably in a range of 3 percent to 10 percent, and a thickness of the wall of the swirler assembly is desirably in a range of 2 mm to 7 mm.

Also, the swirler assembly housing may include an upper section opposing to the wall of the swirler assembly; and side sections extending from the upper section and connected with the wall of the swirler assembly to form the housing resonance space. Hole may be opened in at least one of the side sections. In this case, each of the side sections may include a flat plate section; and a curved section smoothly connecting the flat plate section and the upper section, such that an angle between the flat plate section and the upper section is obtuse.

Also, each of the side sections may be connected with the wall of the swirler assembly such that an angle between the wall of the swirler assembly and a surface of the side section opposite to the housing resonance space is obtuse.

Also, the thickness of the swirler assembly housing may be in a range of 1.6 mm to 5 mm, and a radius of curvature of the curved section may be in a range of 5 mm to 20 mm.

Also, the housing resonance space is single in an inside of the swirler assembly housing. Also, the swirler assembly housing is single.

Also, the swirler assembly housing is connected with an outer surface of the wall of the swirler assembly, and an inner surface of the wall of the swirler assembly corresponding to the swirler assembly housing has a heat-resistant coating layer.

Also, the plurality of swirler assembly through-holes may be uniformly distributed in the predetermined circumferential region. Instead, the plurality of swirler assembly through-holes may be ununiformly distributed in the predetermined circumferential region based on a temperature distribution in the combustion region.

In another aspect of the present invention, a method of manufacturing a gas turbine combustor is achieved by providing a combustion liner housing with a first slag hole; by coupling the combustion liner housing to the combustion liner by welding; and by taking-out weld slag left in the combustion liner housing from the first slag hole. In this case, the method of manufacturing a gas turbine combustor may further include blocking the first slag hole after the taking-out step.

Also, the method of manufacturing a gas turbine combustor may be achieved by further coupling a swirler assembly housing with a second slag hole to the swirler assembly by welding; and by taking out weld slag left in the swirler assembly housing from the second slag hole. In this case, the method of manufacturing a gas turbine combustor may further include blocking the second slag hole after the taking-out step from the second slag hole.

In another aspect of the present invention, a method of manufacturing a gas turbine combustor is achieved by providing a swirler assembly housing with a first slag hole; by coupling the swirler assembly housing to the swirler assembly by welding; and by taking-out weld slag left in the swirler assembly housing from the first slag hole. In this case, the method of manufacturing a gas turbine combustor may further include blocking the first slag hole after the taking-out step.

DESCRIPTION OF THE PREFERRED EMBODIMENTS

Hereinafter, a gas turbine combustor of the present invention will be described in detail with reference to the attached drawings. The gas turbine combustor of the present invention is preferably applied to a gas turbine generation plant.

Figure 1:
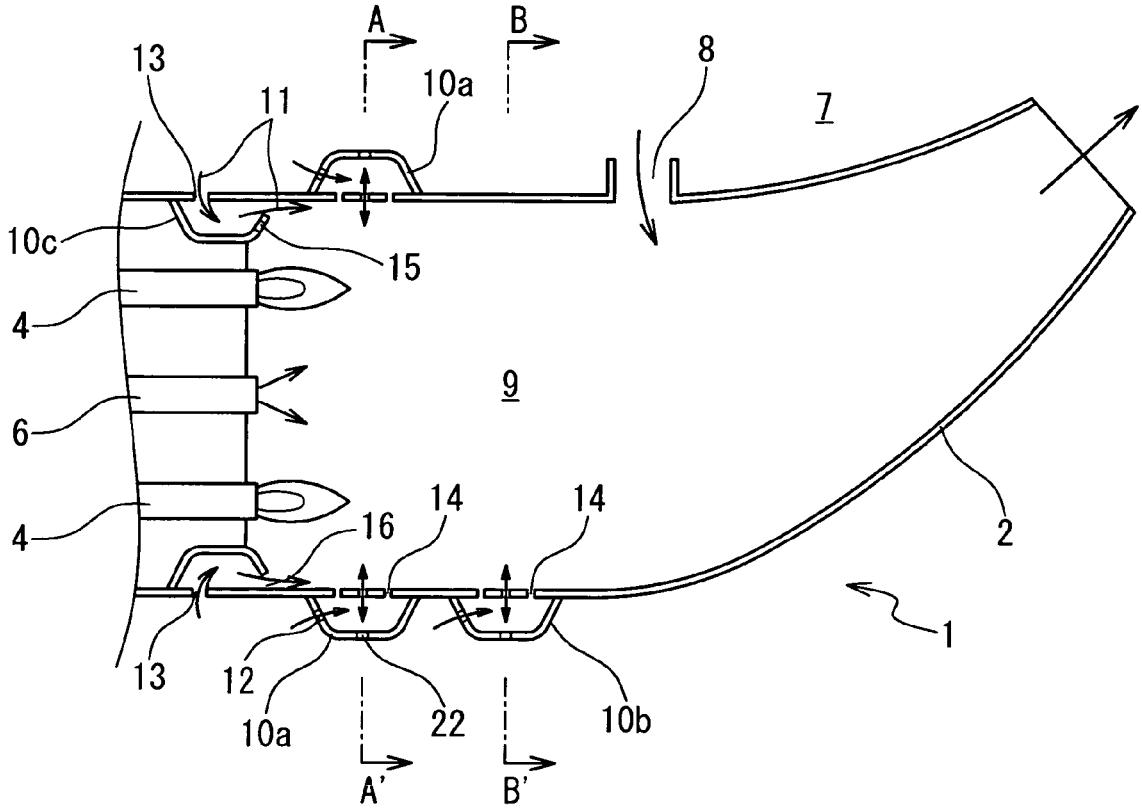
FIG. 1 shows the structure of a gas turbine combustor of an embodiment of the present invention.

FIG. 1 is a cross sectional view showing the structure of the gas turbine combustor. Referring to FIG. 1, a gas turbine combustor 1 has a combustion liner 2. The combustion liner 2 has a cylindrical shape, and contacts a cooling air region 7. A combustion region 9 is formed inside the combustion liner 2. A premixing nozzle 4 and a pilot nozzle 6 are provided on the upstream side of the combustion liner 2. A bypass flow path 8 is provided for the combustion liner 2 to introduce air into the combustion region. 9. An air inlet 13 is provided for the combustion liner 2 to introduce a part of compressed air discharged from a compressor (not shown).

Many holes 14 are provided for the combustion liner 2. Housings 10*a* and 10*b* are provided for the outer circumference of the combustion liner 2 in a region where the holes 14 are provided, to form spaces in the outer surface of the combustion liner 2. Cooling holes 12 are provided for the side portion of the housings 10*a* and 10*b*. It is desirable that a lot of the cooling holes 12 are provided for the side portions of the housings 10*a* and 10*b* on the upstream side. Purge holes 22 are provided for the surfaces of the housings 10*a* and 10*b* which are opposite to the surface of the combustion liner 2. Hereinafter, a combustion vibration restraint section which is composed of the housing and the many holes 14 formed on the liner 2 and is referred to as an acoustic liner.

A housing 10*c* is provided for the inner circumference of the combustion liner 2 where the air inlet 13 is provided and forms a space from the inner wall of the combustion liner 2, i.e., on the side of the combustion region 9. The housing 10*c* has a gap 16 on the downstream side, and the inside of the housing 10*c* and the combustion region 9 are connected through the gap 16. It is desirable that other air inlets are provided on other positions other than the position where the housing 10*c* is provided. Also, the housing 10*c* is provided in the neighborhood of the premixing nozzle 4 but may be provided on the downstream side.

Figure 2A:
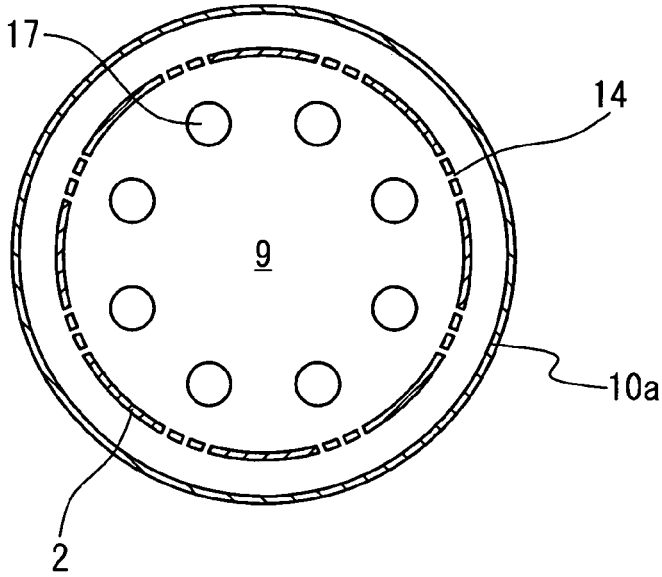
FIG. 2A is a cross sectional view of the combustor along the A–A' line of FIG. 1.

FIG. 2A is a cross sectional view of the combustor along the A–A' line of FIG. 1. The housing 10*a* is provided over the whole outer circumference of the combustion liner 2 to surround the periphery of the combustion liner 2. No partition is provided inside the housing 10*a*, resulting in a single space. Therefore, the manufacture of the housing 10*a* is easy and the housings 10*a* and 10*b* are light in weight. In the combustion region 9 contains hotter regions 17 which become hotter than the other regions. The hotter region 17 is located on the downstream side of the premixing nozzle 4. The many holes 14 are provided for the wall of the combustion liner 2 in a place near the hotter region 17. The holes 14 may be provided less in the place farther from the hotter region 17 or there may be no hole 14.

Figure 2B:
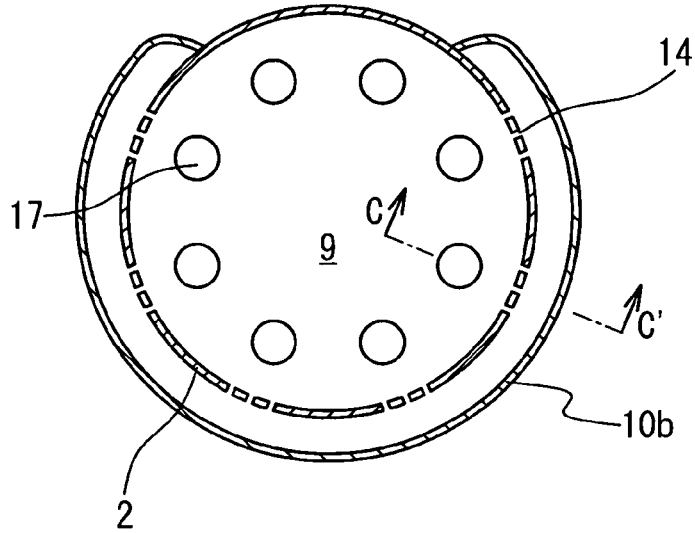
FIG. 2B is a cross sectional view showing the combustor along the B–B' line of FIG. 1.

FIG. 2B is a cross sectional view showing the combustor along the B–B' line of FIG. 1. The housing 10*b* is formed to cover a portion of the outer circumference of the combustion liner 2 in angular region less than 360 degrees. Therefore, it is possible to attach the housing 10*b* to the combustion liner 2 to avoid interference with a structural component provided around the combustion liner 2. It is desirable that the circumferential length of the housing 10*b* is equal to or longer than the diameter of the combustion liner 2. In other words, it is desirable that the angle of the portion covered by the housing 10*b* is roughly equal to or more than 115 degrees. There is no partition in the housing 10*b*, to form a single space. Therefore, the manufacture of the housing 10*b* is easy and the housing 10*b* is light in weight.

Figure 2C:
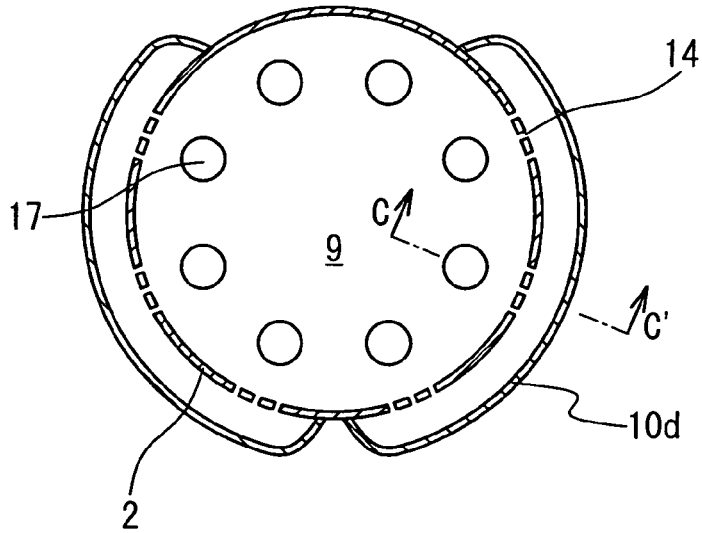
FIG. 2C is a cross sectional view of a modification of the combustor of the present invention.

FIG. 2C is a cross sectional view of a modification of the combustor of the present invention. Two housings 10*d* are provided on the outer circumference of the combustion liner 2 on symmetrical positions with respect to a plane passing a center axial of the combustor to cover an region larger than 115 degrees and less than 180 degrees. In the combustion region 9, there are hotter regions 17 which become hotter than the other regions. More holes 14 are provided for the wall of the combustion liner 2 in the place near hotter regions 17. Less hole 14 are provided for the wall of the combustion liner 2 in the place apart from the hotter regions 17 or no hole 14 is provided.

Figure 3:
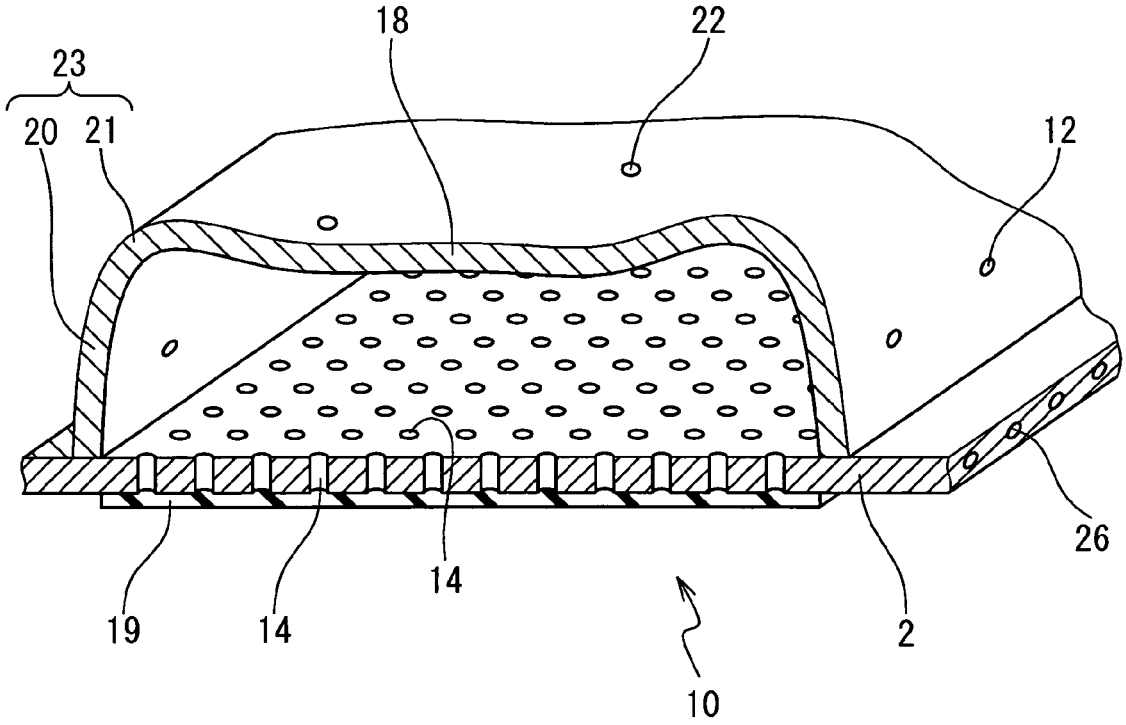
FIG. 3 is a broken perspective view showing the structure of an acoustic liner.

Referring to FIG. 3, the broken perspective view of the housing 10 (housing 10*a* or 10*b* in FIG. 1) is shown. The housing 10 has side sections 23 connected with the wall of the combustion liner 2 and an upper section 18 extending from the side section 23 to oppose to the wall of the combustion liner 2. The side section 23 has a flat plate section 20 coupled to the combustion liner 2 and a curved section 21 connecting the plate section 20 and the upper section 18. The purge holes 22 are provided for the upper section 18. The cooling holes 12 are provided for the plate section 20. No purge hole and no cooling hole may be provided. A heat-resistant coating 19 is applied to the inner surface of the combustion liner 2 on the side the combustion region 9 in the region in which the housing 10 is provided. The material of heat-resistant coating 19 is such as ceramic, alumina, and yttrium alloy. The heat-resistance of the wall for which the many holes 14 are provided is enhanced by such a heat-resistant coating 19. The radius of curvature of the curved section 21 is as large as about 10 mm. Because the curvature is large, the stress is small in the corner portion. The upper section 18 opposes to the wall of the combustion liner 2 in parallel. The angle between the upper section 18 and the plate section 20 is as obtuse as about 100 degrees. Therefore, the stress becomes smaller in the corner. The housing 10 is produced through a press process. The upper section 18 has the shape that the central region far from the curved section 21 is hollow rather than the region near the curved section 21. This hollow shape is obtained generally in the bottom of a product produced through the press process. As shown in FIG. 3, cooling paths 26 are provided in the combustion liner 2 for cooling medium.

Figure 4:
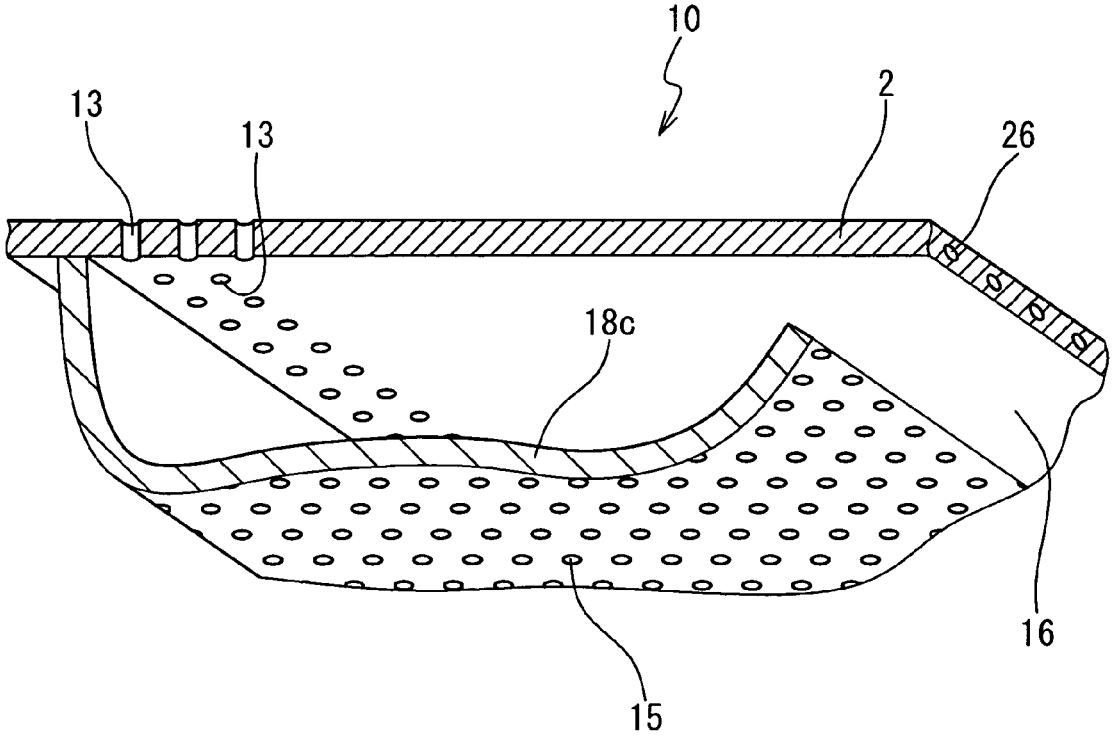
FIG. 4 is a broken perspective view showing the structure of another acoustic liner.

FIG. 4 is a broken perspective view showing the housing 10*c*. Holes of the air inlet 13 are provided for the wall of the combustion liner 2 in the region for which the housing 10*c* is provided. Many holes 15 are provided for the upper section 18*c* of the housing 10*c*. The gap 16 is provided between the upper section 18*c* and the inner wall of the combustion liner 2 in the end of the housing 10*c* on the downstream side. The cooling paths 26 are provided inside the wall of the combustion liner 2 in the axial direction of the combustion liner 2, similar to FIG. 3.

Figure 5:
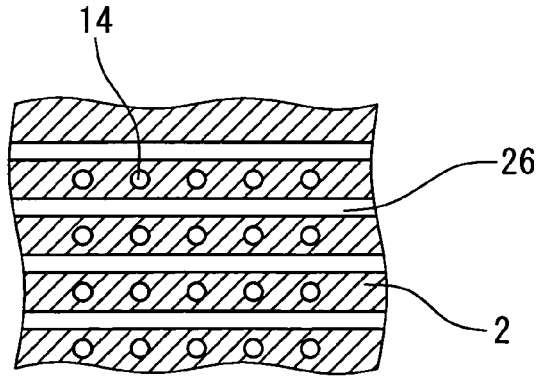
FIG. 5 is a cross sectional view showing the wall of the combustion liner 2 along the plane parallel to the wall.

FIG. 5 is a cross sectional view showing the wall of the combustion liner 2 in the neighborhood where the housing 10 is provided, along the plane parallel to the wall. The plurality of cooling paths 26 are provided inside the wall in parallel and the holes 14 are provided between the cooling paths 26.

Figure 6A:
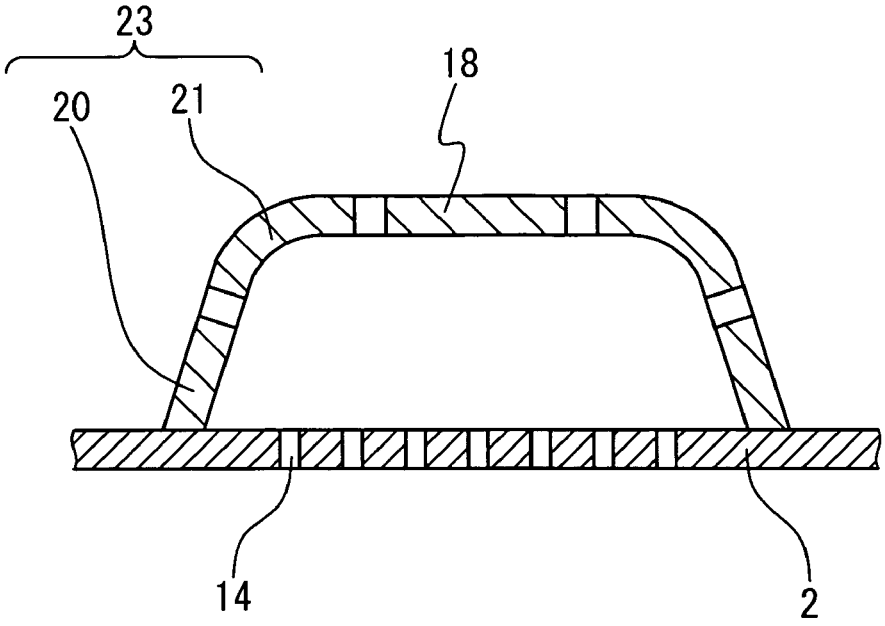
FIG. 6A shows the shape of the section of the acoustic liner.

FIG. 6A shows the shape of the section of the acoustic liner. The housing 10 has the side sections 23 connected to the combustion liner 2 and the upper section 18 extending from the side sections 23 to oppose to the wall of the combustion liner 2. The upper section 18 is perpendicular to the direction of the diameter of the combustion liner 2, as described with reference to FIG. 3.

Figure 6B:
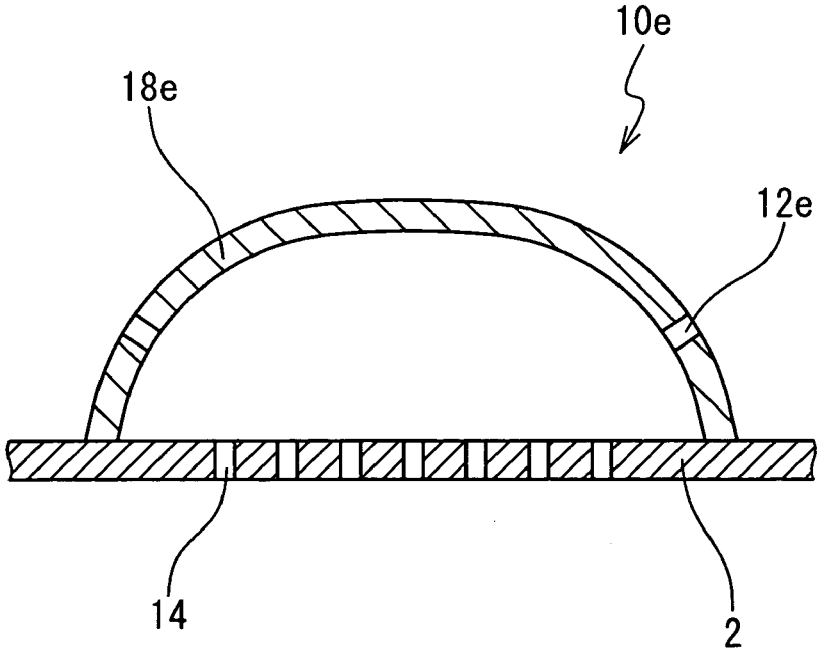
FIG. 6B shows the shape of the section of a modification of the acoustic liner.

FIG. 6B shows the shape of the section of a modification of the acoustic liner. When a housing 10*e* is cut in an axial direction of the combustion liner 2, the housing 10*e* is composed of an upper section 18*e* of a semi-elliptical form along the major axis. The housing 10*e* is desirable in that the stress is less.

Figure 6C:
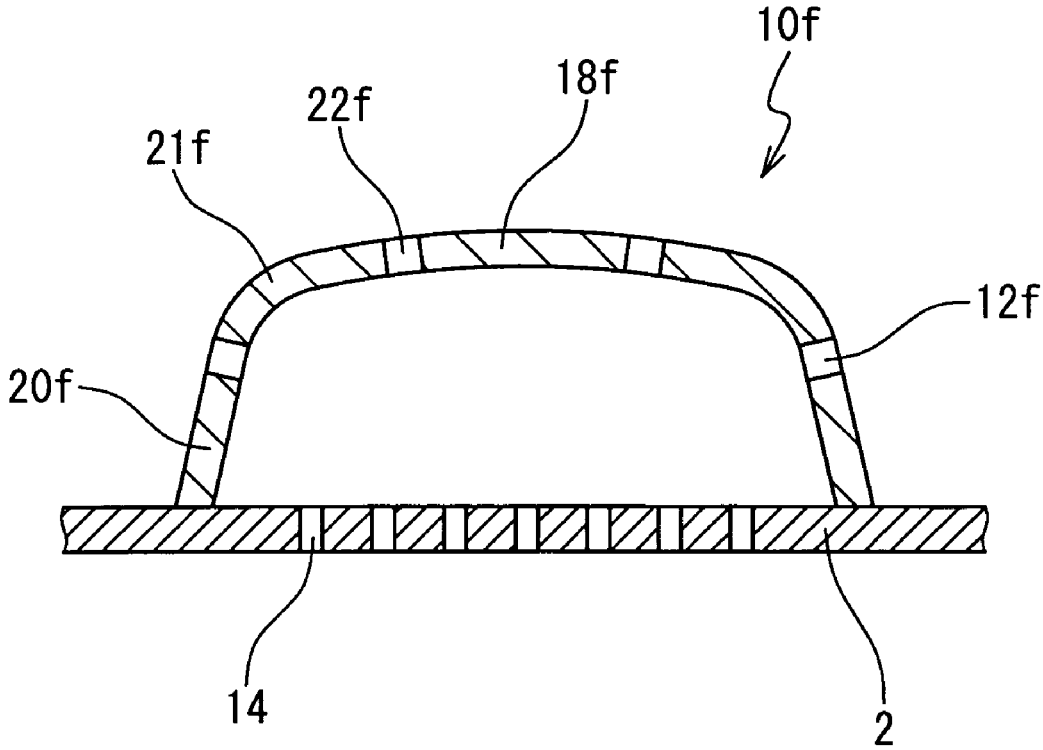
FIG. 6C shows the shape of the section of another modification of the acoustic liner.

FIG. 6C shows a cross section of the acoustic liner in another modification of the embodiment. In a housing 10*f*, the upper section 18 of the housing 10*f* shown in FIG. 3 is replaced by an upper section 18*f* having a convex shape in the direction apart from the wall of the combustion liner 2. Such a housing 10*f* is desirable in that the stress in the curved section 21*e* is less, resulting in high strength.

The characteristic of the acoustic liner can be thought as a simple vibration model that the space in the housing functions as a spring, a fluid particle in the through-hole functions as a mass and the fluid resistance in the through-hole functions as attenuation. It is necessary to determine the size of the space in the housing, the through-hole diameter, a pitch between the holes, and the thickness of the wall of the combustion liner in accordance with the frequency and magnitude of the combustion vibration to be restrained.

The inventors achieved a desirable sound absorption characteristic of the acoustic liner designed as follows.

(1) The distance between the wall of the combustion liner 2 and the upper section 18 of the housing 10 is in a range of 10 mm to 30 mm.

(2) A percentage of a total of areas of the holes 14 to the region where the holes 14 are provided (that is, the region which is covered with the housing 10) is in a range of 3% to 10%.

(3) The thickness of the wall of the combustion liner 2 is in a range 2 mm to 7 mm.

The characteristic of the acoustic liner is determined in relation to these values. Therefore, the combustor which is manufactured to meet the above conditions (1) to (3) at the same time represents an exceptional multiplying effect.

The acoustic liner has the dual structure of the wall of the combustion liner 2 and the housing 10. The balance between the wall of the combustion liner 2 and the housing 10 is important from the viewpoint of the strength of the structure. The inventors achieved the combustor which has desirable strength with the acoustic liner designed as follows.

(4) The thickness of the wall of the combustion liner 2 is in a range of 2 mm to 7 mm.

(5) The thickness of the housing 10 is in a range of 1.6 mm to 5 mm.

(6) The radius of curvature of the curved section 21 coupling the upper section 18 of the housing 10 and the plate section 20 is in a range of 5 mm to 20 mm.

(7) The side section 23 is inclined in a between 0 degree and 20 degrees from a direction perpendicular to the wall of combustion liner 2 (that is, an angle between the plane of the side section 23 contacting the cooling air and a plane of the wall of the combustion liner 2 is less than 110 degrees).

The strength of the acoustic liner is determined in relation to these values. Therefore, the combustor which is manufactured to meet the above conditions (4) to (7) at the same time represents an exceptional multiplying effect. Moreover, if the above combustor is further composed of cooling paths 26, high strength is achieved.

Moreover, the acoustic liner of the present invention has high strength since there is little weld section in the liner, compared with the structure in which a lot of small acoustic liners (the maximum circumferential length is smaller than the diameter of the combustion liner) are provided or the structure which partitions are provided inside the housing.

When the structure has the partitions, the structure meeting the conditions (1) to (3) and the structure meeting the conditions (4) to (7) at the same time, the combustor has the exceptional multiplying effect to achieve the restraint of the combustion vibration and extreme high strength at the same time.

Figure 7:
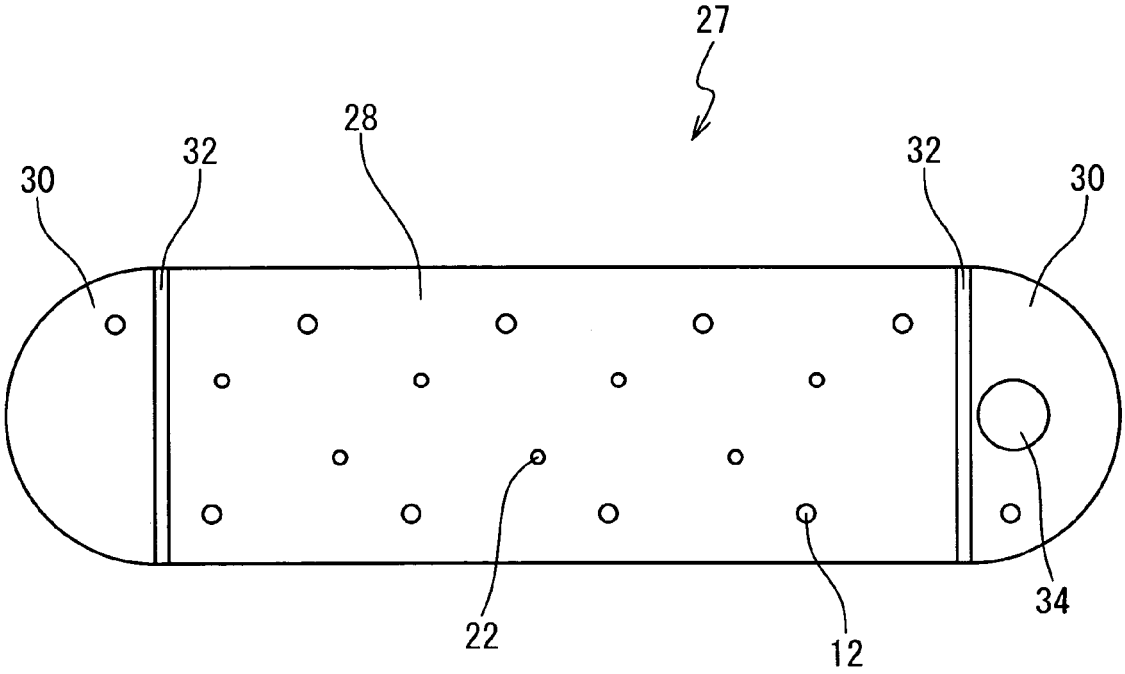
FIG. 7 is a plan view showing the shape of the acoustic liner before pressing.

FIG. 7 shows a metal plate 27 before being pressed to the housing 10*b*. The metal plate 27 is composed of a rectangular body section 28. The cooling holes 12 and the purge holes 22 are formed in the body section 28. Semicircular sections 30 are coupled to the both ends of the body section 28 in the longitudinal direction by welding sections 32. A slag pulling-out hole 34 which is enough to take away weld slag is provided for the end 30. The hole 34 may be provided for both of the ends 30. The metal plate 27 is pressed and welded to the wall of the combustion liner 2. Thus, the housing 10 is formed to have the section shape shown in FIG. 3. The weld slag generated in the welding is removed from the slag pulling-out hole 34. In case that it is desirable that the slag pulling-out hole 34 does not exist, the hole 34 is covered by the welding. By forming the slag pulling-out hole 34, the influence of the remaining slag on the characteristic of the housing 10 is reduced.

Figure 1A:
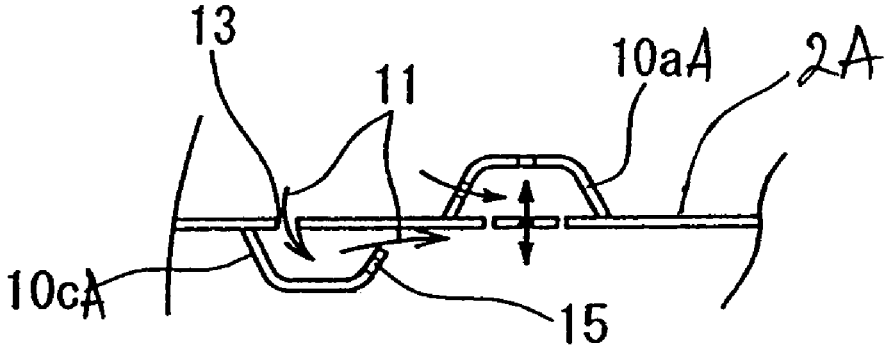
FIG. 1A is a partial view similar to FIG. 1 showing an alternative structure of a gas turbine combustor in accordance with another embodiment.
Figure 1A:
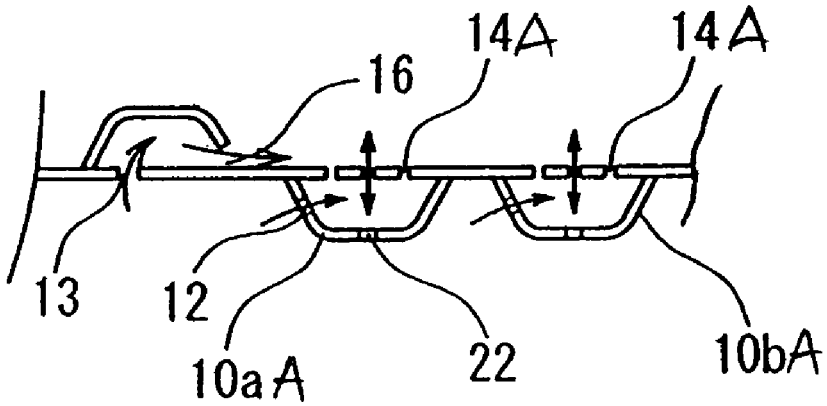

When the acoustic liner of the present invention is attached to the swirler assembly and transition piece of the gas turbine combustor in addition to the combustion liner, the similar effect to the above can be achieved. For example, FIG. 1A shows a further embodiment of the present invention in which the acoustic liner described above with respect to FIGS. 1, 2A–2C, 3–5, 6A–6C and 7 is attached to a swirler support pipe 2A, rather than to combustion liner 2. Swirler support pipe 2A, as the name suggests, is used to support a swirler assembly (not shown in FIG. 1A) in a manner known in the art, and is connectable to combustion liner 2. The acoustic liner in FIG. 1A is similar to the acoustic liner described above with respect to FIGS. 1, 2A–2C, 3–5, 6A–6C and 7, and includes one or more of swirler support pipe housings 10*a*A, 10*b*A, 10*c*A and a plurality of swirler support pipe through holes 14A formed through swirler support pipe 2A. Swirler support pipe housings 10*a*A, 10*b*A, 10*c*A and through holes 14A are similar to the above-described housings 10*a*, 10*b*, 10*c* and through holes 14, respectively, and will not be described again for sake of simplicity.

The combustor 1 having the above-mentioned structure operates as follows.

When the gas turbine system which contains the combustor 1 is operated, cooling air 11 compressed by a compressor (not shown) flows into the housing 10*c* through an air inlet 13. Fuel and air are supplied from the premixing nozzle 4 and the pilot nozzle 6. The supplied fuel is ignited by an igniter (not shown) and the combustion region 9 is filled with the flame and hot combustion gas. The hot combustion gas flows out from the transition piece on the downstream side and is supplied to the gas turbine (not shown).

The cooling air 11 is blown out from the gap 16 of the housing 10*c*. The cooling air 11 flows along the wall of the combustion liner 2 to cool the wall. The cooling air 11 or steam flows through the cooling paths 26. Thus, the wall of the combustion liner 2 is effectively cooled.

Combustion vibration is caused in the frequency peculiar to the combustion liner 2 through combustion in the combustion region 9. The combustion gas vibrates intensely in holes 14 and 15. The vibration attenuates due to friction of the combustion gas and the wall of the holes 14 and 15. That is, supposing that the housing 10 is a spring, the holes 14 and 15 function as a damper to convert the vibration of the spring into heat so as to attenuate the vibration of the spring. As a result, the combustion vibration of the combustor 1 is restrained.

In the region in which the housing 10 is provided, the more holes 14 are provided for the hotter regions 17. In this case, convection generated due to the hotter regions 17 and a lower temperature region can be restrained in the housing 10. Therefore, the flow of combustion gas in the combustion region 9 into the inside of the housing 10 is restrained.

The purge air flows into the housing 10 through the purge holes 22. The pressure in the housing 10 becomes high because of the purge air and the flow of the combustion gas into the inside of the housing 10 is restrained in the combustion region 9. The cooling air 11 flows into the housing 10 through the cooling hole 12. The cooling air 11 cools the wall of the combustion liner 2. Therefore, the wall can be effectively cooled although the wall portion where the holes 14 are formed so that the strength is weaker than the other portion. Because the cooling holes 12 are provided for the plate section 20 nearer the wall of the combustion liner 2 than the purge holes 22, the cooling air 11 flowing through the cooling holes 12 cools the wall of the combustion liner 2 effectively.

Conventionally, the inside of the housing 10 is often partitioned into small rooms. When there is no partition, the sound absorption efficiency of the acoustic liner (the efficiency to absorb acoustic energy of the combustion vibration inputted to the acoustic liner) decreases depending on the incident angle of the sound wave inputted from the inside of the combustor to the acoustic liner. From the above reason, the partition is often adopted. However, no partition is provided for the inside of the housing 10 of the present invention.

The inventors of the present invention discovered the following fact through calculation of a resonance mode in the combustion liner 2 and the sound absorption characteristic of the acoustic liner. That is, the discovered fact is that even if there was not an acoustic liner, the large combustion vibration does not occur under the condition of the incident angle of the sound wave that the sound absorption efficiency of the acoustic liner is degraded exceedingly. Therefore, it is concluded that it is not necessary to provide any partition in the housing.

In the above-mentioned calculation, the conditions are adopted that the section of the combustion liner 2 is circular and the housing 10 covers a considerable circumferential part of the wall of the combustion liner 2, e.g., a circumferential portion longer than the diameter of the combustion liner. In the above-mentioned calculation, as an example when the inside of the housing is partitioned by many partitions, it is considered that the inside of the housing is divided into many small rooms and the a total of circumferential lengths of the small rooms covering the combustion liner is as small as ignorable, compared with the diameter of the combustion liner 2.

The housing 10 of the present invention can achieve the sound absorption efficiency equivalent to that of the housing in which many partitions are provided, without any partition, based on the above-mentioned calculation. Such a housing 10 is light because no partition is provided. The manufacture of the housing 10 is easy and the manufacturing cost can be reduced.

According to the present invention, the combustor for the gas turbine is provided which has a combustion vibration restraint section with high heat resistance. Moreover, the combustion vibration restraint section is light and simple in the structure.

What is claimed is:

1. A gas turbine combustor, comprising:

a combustion liner in which a combustion region is formed; and a housing provided for a wall of said combustion liner in a predetermined circumferential region of said combustion liner to form a resonance space between said combustion liner and said housing, wherein said combustion region and said resonance space are connected by a plurality of combustion liner through-holes;

a circumferential length of said housing is longer than a diameter of said combustion liner; and said housing comprises:

an upper section opposing to the wall of said combustion liner; and side sections extending from said upper section and connected with the wall of said combustion liner to form said resonance space, wherein holes are opened in at least one of said side sections.

2. The gas turbine combustor according to claim 1, wherein a distance between said wall of said combustion liner and said housing is in a range of 10 mm to 30 mm, the diameter of each of said plurality of combustion liner through-holes is in a range of 1 mm to 5 mm, a percentage of a total of areas of said plurality of combustion liner through-holes to an area of said predetermined circumferential region is in a range of 3 percent to 10 percent, and a thickness of the wall of said combustion liner is in a range of 2 mm to 7 mm.

3. The gas turbine combustor according to claim 1, wherein each of said side sections comprises:

a flat plate section; and a curved section smoothly connecting said flat plate section and said upper section, such that an angle between said flat plate section and said upper section is obtuse.

4. The gas turbine combustor according to claim 3, wherein a thickness of said housing is in a range of 1.6 mm to 5 mm, and a radius of curvature of said curved section is in a range of 5 mm to 20 mm.

5. The gas turbine combustor according to claim 1, wherein each of said side sections is connected with the wall of said combustion liner such that an angle between the wall of said combustion liner and a surface of said side section opposite to said resonance space is obtuse.

6. The gas turbine combustor according to claim 1, wherein said resonance space occupies an entire interior of said housing which is free of partition walls.

7. The gas turbine combustor according to claim 6, having only one said housing.

8. The gas turbine combustor according to claim 1, wherein said housing is connected with an outer surface of the wall of said combustion liner, and an inner surface of the wall of said combustion liner corresponding to said housing has a heat-resistant coating layer.

9. The gas turbine combustor according to claim 1, wherein said combustion liner through-holes are uniformly distributed in said predetermined circumferential region.

10. The gas turbine combustor according to claim 1, wherein said combustion liner through-holes are ununiformly distributed in said predetermined circumferential region based on a temperature distribution in said combustion region.

11. The gas turbine combustor according to claim 1 further comprising:

a swirler support pipe connected with said combustion liner; and a swirler support pipe housing provided for a wall of said swirler support pipe in a predetermined circumferential region of said swirler support pipe to form a further resonance space between said swirler support pipe and said swirler support pipe housing;

wherein said combustion region and said further resonance space are connected by a plurality of swirler support pipe through-holes; and a circumferential length of said swirler support pipe housing is longer than a diameter of said swirler support pipe.

12. A gas turbine generation plant, comprising a gas turbine combustor according to claim 1.

13. A gas turbine combustor, comprising:

a swirler support pipe;

a combustion liner connected with said swirler support pipe, a combustion region being formed in said combustion liner; and a swirler support pipe housing provided for a wall of said swirler support pipe in a predetermined circumferential region of said swirler support pipe to form a resonance space between said swirler support pipe and said swirler support pipe housing;

wherein an inner space within said swirler support pipe and said resonance space are connected by a plurality of swirler support pipe through-holes;

a circumferential length of said swirler support pipe housing is longer than a diameter of said swirler support pipe; and said swirler support pipe housing comprises:

an upper section opposing to the wall of said swirler support pipe; and side sections extending from said upper section and connected with the wall of said swirler support pipe to form said resonance space, wherein holes are opened in at least one of said side sections.

14. The gas turbine combustor according to claim 13, wherein a distance between said wall of said swirler support pipe and said swirler support pipe housing is in a range of 10 mm to 30 mm, the diameter of each of said plurality of swirler support pipe through-holes is in a range of 1 mm to 5 mm, a percentage of a total of areas of said plurality of swirler support pipe through-holes to an area of said predetermined circumferential region is in a range of 3 percent to 10 percent, and a thickness of the wall of said swirler support pipe is in a range of 2 mm to 7 mm.

15. The gas turbine combustor according to claim 13, wherein each of said side sections comprises:

a flat plate section; and a curved section smoothly connecting said flat plate section and said upper section, such that an angle between said flat plate section and said upper section is obtuse.

16. The gas turbine combustor according to claim 15, wherein a thickness of said swirler support pipe housing is in a range of 1.6 mm to 5 mm, and a radius of curvature of said curved section is in a range of 5 mm to 20 mm.

17. The gas turbine combustor according to claim 13, wherein each of said side sections is connected with the wall of said swirler support pipe such that an angle between the wall of said swirler support pipe and a surface of said side section opposite to said resonance space is obtuse.

18. The gas turbine combustor according to claim 13, wherein said resonance space occupies an entire interior of said swirler support pipe housing which is free of partition walls.

19. The gas turbine combustor according to claim 18, having only one said swirler support pipe housing.

20. The gas turbine combustor according to claim 13, wherein said swirler support pipe housing is connected with an outer surface of the wall of said swirler support pipe, and an inner surface of the wall of said swirler support pipe corresponding to said swirler support pipe housing has a heat-resistant coating layer.

21. The gas turbine combustor according to claim 13, wherein said swirler support pipe through-holes are uniformly distributed in said predetermined circumferential region.

22. The gas turbine combustor according to claim 13, wherein said swirler support pipe through-holes are ununiformly distributed in said predetermined circumferential region based on a temperature distribution in said combustion region.

23. A gas turbine generation plant, comprising a gas turbine combustor according to claim 13.

24. A method manufacturing a gas turbine combustor, comprising:

providing a combustion liner in which a combustion region is to be formed;

forming a plurality of combustion liner through-holes through a wall of said combustion liner and in a predetermined circumferential region of said combustion liner;

providing a plate for forming a combustion liner housing, said plate having a first slag hole and a plurality of further holes;

welding said plate to said combustion liner to form the combustion liner housing; and removing weld slag left in said combustion liner housing via said first slag hole;

wherein the plate is provided and welded to the combustion liner so that the formed combustion liner housing (i) extends over the predetermined circumferential region of said combustion liner, (ii) defines a resonance space located between said combustion liner and said housing and connected to the combustion region by the combustion liner through-holes, and (iii) comprises:

an upper section opposing to the wall of said combustion liner; and side sections extending from said upper section and connected with the wall of said combustion liner to form said resonance space, wherein some of said further holes of the plate are opened in at least one of said side sections.

25. The method according to claim 24, further comprising:

blocking said first slag hole after said removing.

26. The method according to claim 24, further comprising:

coupling a swirler support pipe to said combustion liner;

welding a swirler support pipe housing with a second slag hole to said swirler support pipe; and removing weld slag left in said swirler support pipe housing via said second slag hole.

27. The method according to claim 26, further comprising:

blocking said second slag hole after removing weld slag via said second slag hole.

28. A method of manufacturing a gas turbine combustor, comprising:

providing a swirler support pipe;

forming a plurality of swirler support pipe through-holes through a wall of said swirler support pipe and in a predetermined circumferential region of said swirler support pipe;

providing a plate for forming a swirler support pipe housing, said plate having a first slag hole and a plurality of further holes;

welding said plate to said swirler support pipe to form the swirler support pipe housing; and removing weld slag left in said swirler support pipe housing via said first slag hole;

wherein the plate is provided and welded to the swirler support pipe so that the formed swirler support pipe housing (i) extends over the predetermined circumferential region of said swirler support pipe, (ii) defines a resonance space located between said swirler support pipe and said housing and connected to an inner space of said swirler support pipe by the swirler support pipe through-holes, and (iii) comprises:

an upper section opposing to the wall of said swirler support pipe; and side sections extending from said upper section and connected with the wall of said swirler support pipe to form said resonance space, wherein some of said further holes of the plate are opened in at least one of said side sections.

29. The method according to claim 28, further comprising:

blocking said first slag hole after said removing.

* * * * *